United States Patent [19]

Spence et al.

[11] 4,268,089

[45] May 19, 1981

[54] MOUNTING MEANS FOR PICK ON MINING DRUM VANE

[75] Inventors: Adam M. Spence, Doncaster; James R. Goff, Brockenhurst, both of England

[73] Assignee: Winster Mining Limited, England

[21] Appl. No.: 43,774

[22] Filed: May 30, 1979

[30] Foreign Application Priority Data

May 31, 1978 [GB] United Kingdom ..... 25127/78

[51] Int. Cl.[3] ..... E21C 35/18

[52] U.S. Cl. ..... 299/87; 299/81; 299/91

[58] Field of Search ..... 299/87, 91–93

[56] References Cited

FOREIGN PATENT DOCUMENTS 774261 5/1957 United Kingdom .
991569 5/1965 United Kingdom .
1144434 3/1969 United Kingdom .
1209374 10/1970 United Kingdom .
1250858 10/1971 United Kingdom .
1493907 11/1977 United Kingdom .

*Primary Examiner*—Ernest R. Purser
*Attorney, Agent, or Firm*—Merriam, Marshall & Bicknell

[57] ABSTRACT

A cutting drum for a mining machine, for example a shearer drum comprising helical vanes, to which picks are secured at spaced intervals peripherally thereof. In conventional practice, housings for the picks are secured such as by welding directly to the shearer drum vane. In accordance with the invention, a mounting device is fixedly secured to the shearer drum vane, and the housing for the pick is releasably secured to the mounting device. This enables the pick housings to be readily removed from the shearer drum, in the event that one or more of the pick housings becomes damaged during operation of the machine.

3 Claims, 6 Drawing Figures

26
6
12
14
14
13

MOUNTING MEANS FOR PICK ON MINING DRUM VANE

BACKGROUND TO THE INVENTION

This invention is concerned with improvements relating to mining machinery, particularly but not exclusively for cutting coal, in which context the invention will hereinafter be described.

A conventional coal cutting machine as used for example for mining coal comprises a cutting head provided with a number of picks secured thereto. Where the cutting head is of the kind having a number of helically-extending vanes (as for example is the case where the cutting head is in the form of a shearer drum) the picks are secured to the vanes so as to attack the coal face as the cutting head is rotated.

Conventional practice is for housings for the picks to be fixedly secured to the vanes of the cutting head by for example a welding operation, and the picks to be releasably secured in the housings with an operative portion protruding therefrom. Such housings are known in the art, and will be referred to hereinafter, as pick boxes.

There are several different types of pick which are designed to attack the coal face in different ways, and normally a cutting head will utilise several different types of pick at different positions around its periphery, in accordance with the type of material being cut. For each type of pick there is conventionally a corresponding type of pick box, into which the pick may be releasably secured.

When a pick becomes worn or broken, a greater load is thrown on the immediately following pick: thus, it is desirable to replace a broken or worn pick as soon as possible. If however, during operation of the cutting head one of the pick boxes becomes damaged, it may be difficult to replace the pick within that box. Thus, when damage is caused to a pick box it is necessary to cut the pick box from the cutting head and to replace it with another pick box.

This is a difficult and time consuming operation, and cannot easily be carried out insitu. Normally replacement of a damaged pick box involves ceasing operation of the machine for an extended period of time, and taking the machine out of service. Thus, and especially where personnel operating the machine are working under a production incentive bonus, there is a tendancy for a broken pick to be left in position, where extraction of the picks from the pick box, and replacement thereof with a new pick, is rendered inpractical due to damage incurred by the pick box.

Primarily this practice is disadvantageous in view of the increased loading placed on the immediately following pick, and consequent increased rate of breakage of said following pick, and an increased utilisation of fresh picks. Additionally, however increased loading is also placed on the box housing the immediately following pick, and consequently a decrease in the life of this pick box.

In normal workings, it will not be until an excessive number of pick boxes are damaged, as causes noticeable impairment in the cutting effeciency of the machine, that the machine will be shut down and all damaged pick boxes replaced. Such practice greatly increases the rate of utilisation of picks and pick boxes, albeit this is offset to some extent by continuing operation of the machine.

It is one of the various objects of this invention to alleviate this problem to some extent at least.

BRIEF SUMMARY OF THE INVENTION

This invention provides a method of mounting picks on the cutting head of a mining machine, in which the pick boxes are releasably secured to the cutting head, and the picks are releasably secured to the pick boxes.

By the use of this method, when a pick box is damaged, it may readily be replaced without taking the cutting head out of service; this encourages early replacement of damaged pick boxes, with consequent maintenance of superior cutting operation of the cutting head, and a reduction in the rate of utilisation of new picks.

Additionally, the various different types of pick each have, in general, an individual design of pick box. Thus, when a pick is damaged, it can normally only be replaced by a similar pick. There is therefore no ready facility for changing the type and arrangement of the picks on the cutting head. However, should it be required to change the arrangement of the picks on the cutting head, by the use of the invention individual pick boxes may readily be removed from the cutting head and replaced with pick boxes designed to accommodate picks of a different type, without taking the cutting head out of service.

Additionally, by the use of the invention, the cutting head can be transported to the face being worked without the pick boxes mounted thereon, and mounting of the pick boxes may be carried out when the cutting head is in situ. This permits somewhat more easy transport of the cutting head, particularly if it is of the kind which is manufactured in sections, and assembled at the face.

This invention also provides, in a cutting head for a mining machine, said cutting head having at least one helically extending vane from which mining picks extend, the improvement wherein the vane is provided with means to enable a plurality of pick boxes to be releasably secured thereto at spaced intervals around the periphery thereof, to each of which pick boxes a mining pick may be secured.

Preferably, the cutting head additionally has the facility for releasably securing to a front face thereof a number of pick boxes, as aforesaid.

Advantageously said means comprises mounting devices, and the vane is provided with a number of slots or recesses within each of which one mounting device may be permanently secured, such as welding, the pick box comprising means adapted to co-operate with the mounting device to enable the pick box to be releasably secured to the mounting device.

Thus, the mounting device may comprise a central plate extending across the slot or recess in a desired orientation, and the pick box comprise two spaced plates which may fit over the central plate, bores being provided in each of the central plate and the spaced plates to accommodate bolts, to permit the pick box to be releasably secured to the central plate. Conversely of course, the mounting device may comprise two spaced plates, and the co-operating means on the pick box may be provided by one central plate, adapted to fit into the space between the said spaced plates.

Thus, it is envisaged that the co-operating means of all the pick boxes will be similar for the several different types of pick box, permitting alternative designs of pick to be secured to the cutting drum and each securing point.

The co-operating means may be afforded in an otherwise conventional pick box, but preferably is provided as an additional feature to a conventional pick box. Thus, conventional pick boxes and conventional picks may readily be modified, to enable utilisation of this invention.

It is however, envisaged that the co-operating means may be afforded by one or more parts permanently secured (such as by welding) to the pick itself, and when it is necessary to change a damaged or work pick, the assembly comprising the pick and said one or more parts is removed from the securing member, discarded, and replaced by an unworn assembly.

DETAILED DESCRIPTION OF A PREFERRED EMBODIMENT

Figure 1:
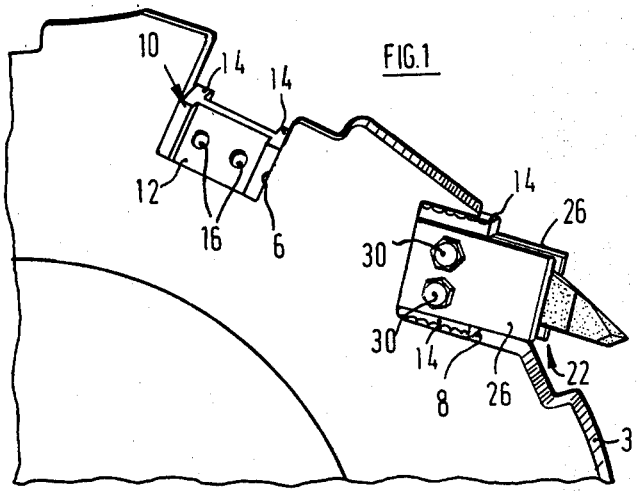
FIG. 1 is a side elevation of part of a vane of a cutting head which is a preferred embodiment of this invention, having been selected to illustrate this invention by way of example.

In FIG. 1, part of a coal cutting machine, specifically part of a cutting drum for use in a long wall mining operation is shown, said cutting drum comprising helically-extending vanes 3, each of which is provided with a number of slots, two of which, identified by the numerals 6 and 8, being shown.

Figure 2:
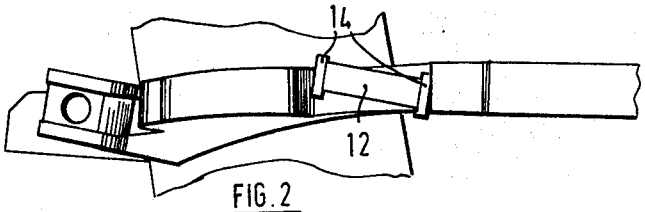
FIG. 2 is a plan view taken on part of FIG. 1.

Extending across the slot 6, and permanently secured therein by a welding operation, is a mounting device 10 comprising a central member afforded by a mild steel plate 12 and two end members 14,14 (see FIG. 2), and extending through the plate 12 are two bores 16,16.

The device 10 is adapted to support a generally conventional pick box 22 of the kind comprising two spaced side plates 26,26 which are adapted to be fitted over the plate 12, with a reasonably tight fit. Extending through the plates 26 are bores 28,28 so spaced apart that when the pick box is fully inserted, said bores 28 are each in axial alignment with one of the bores 16. In such fully inserted position side edges of the plate 26 are in close proximity with the end plates 14 and end faces of each of the plates 26 seat against an upwardly-presented face, either provided by a base member 13 of the mounting device 10, or by portions of the cutting drum vane 3 bounding the slot 6.

Thus, engagement between the central plate 12 and the side plates 26 restrains movement of the pick box in directions transverse to the general plane in which the vane, in the vicinity of the device 10, extends: engagement between the side plates 26 with the respective end members 14 restrains movement of the pick box relative to the mounting device in a direction generally at right angles to the plane of this engagement: and engagement between the end faces of the plates 26 either with a base member 13 if provided, or by portions of the cutting drum vane bounding the slot, restrain the pick box against movement relative to the mounting device in a direction generally at right angles to the plane of this engagement. The diameter of the bores 16 and 28, in conjunction with the diameter of the bolts 30, is thus such that forces tending to cause relative movement between the pick box and the mounting device in directions other than that in which the pick box is removed from the mounting device are taken up by engagement of the pick box with the mounting device, or with the shearer drum vane, as distinct from the bolts 30.

In FIG. 1, one such assembly of pick box and pick is shown secured in position, upon one mounting device.

Figure 3:
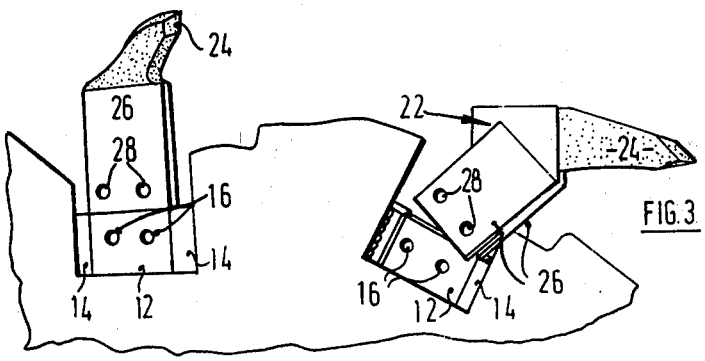
FIG. 3 is a side elevation, taken on FIG. 2, showing the presentation of a pick and pick box, to a mounting device of the cutting head vane.
Figure 4:
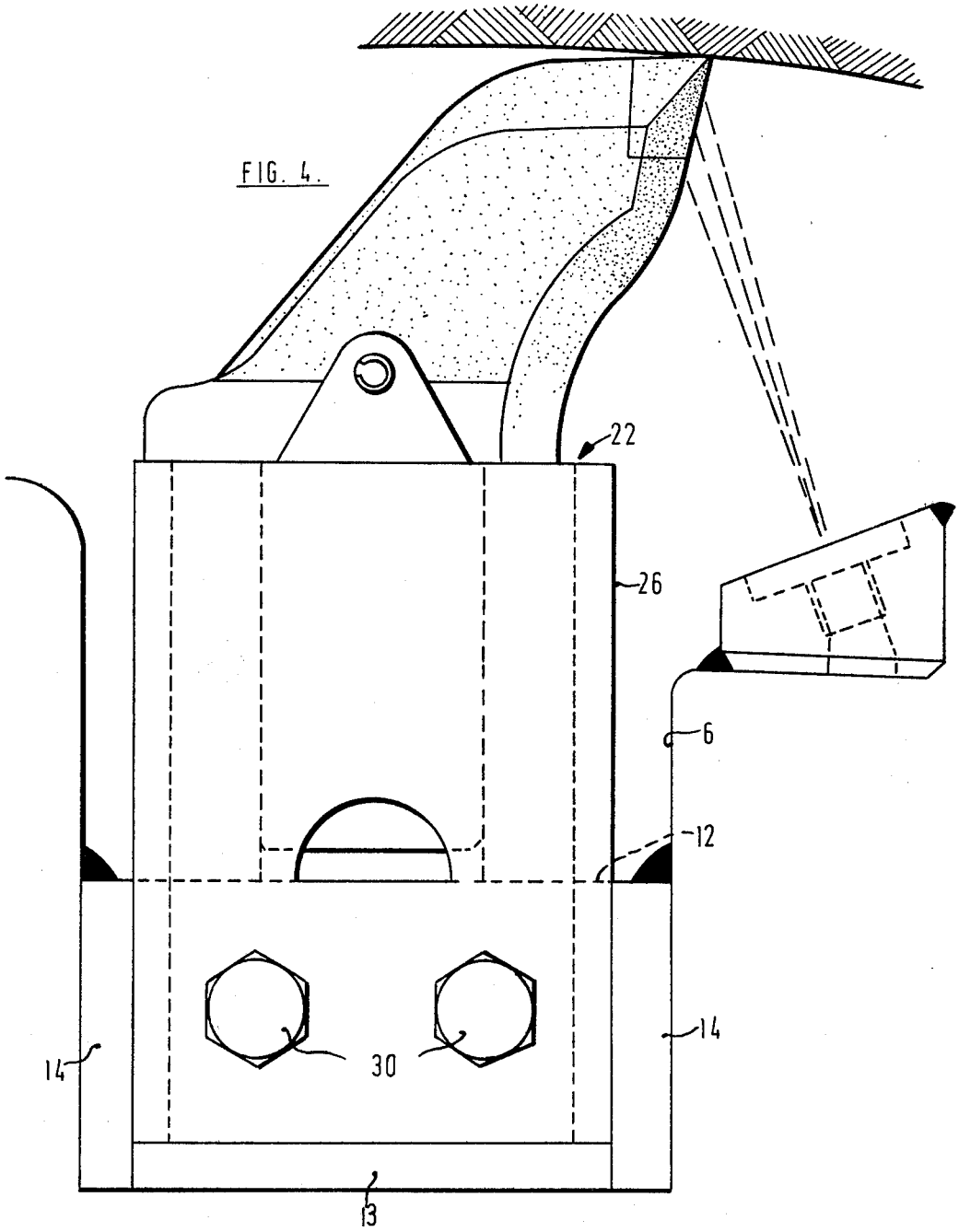
FIGS. 4 and 5 illustrate two different types of pick, secured to the cutting head vane at different positions, by the use of this invention.
Figure 5:
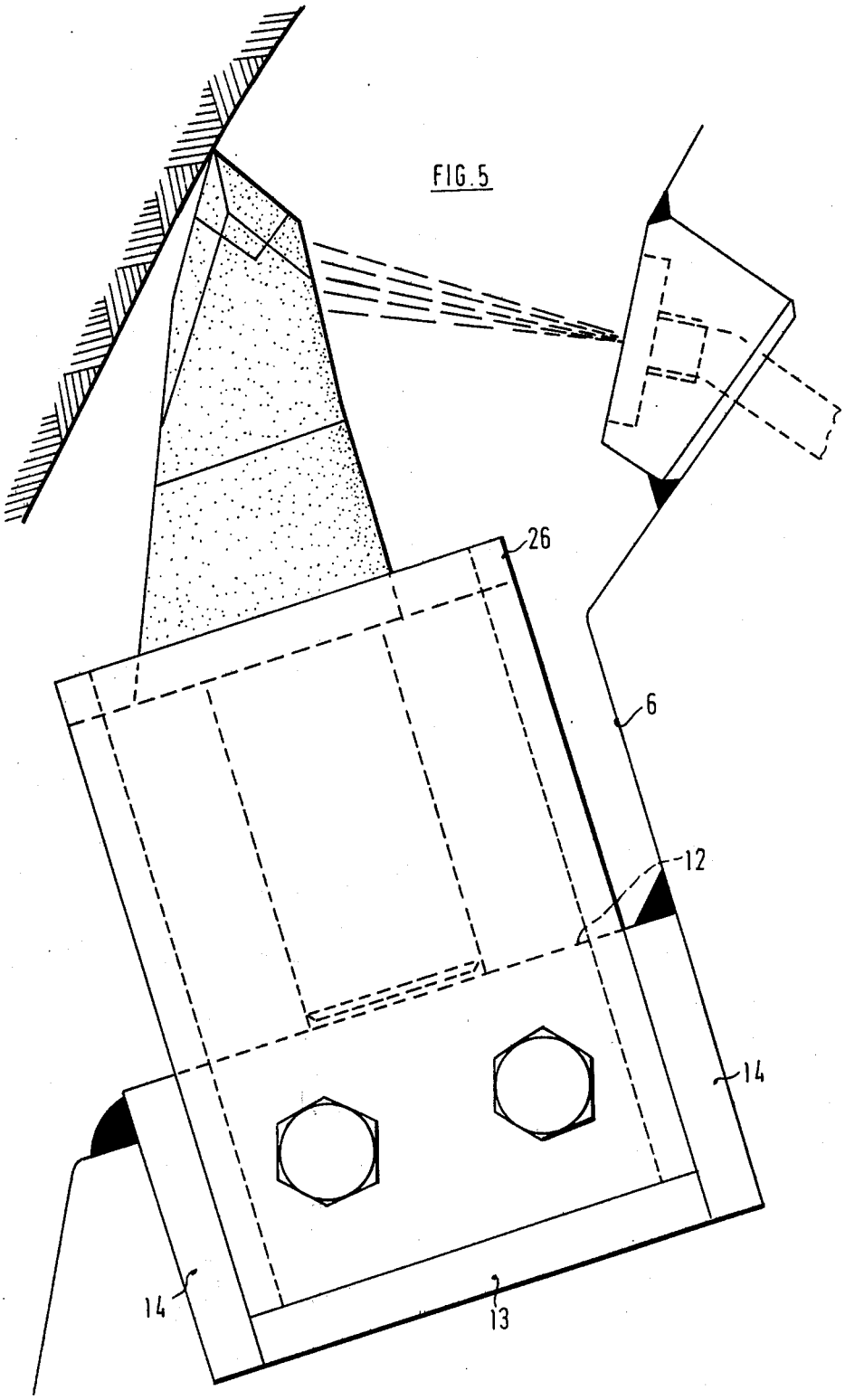

In FIGS. 4 and 5, more detailed views illustrating the use of the invention are shown. In each of these, an otherwise conventional pick housing or box 22 is shown to which side plates 26,26 have been permanently secured. Thus, the pick box may releasably be secured, in the manner illustrated in FIGS. 1 to 3, and in manner which permits inter-changeability of pick boxes and consequently the design of pick used at each securing location. Thus, when the pick illustrated in FIG. 4 becomes worn or broken, it may be detached from its housing (which is retained secured within the vane slot by the bolts 30) and replaced by a fresh pick of similar design. Additionally, should the pick box itself become damaged, it may be removed from the cutting head vane by releasing of the bolts 30. Further, should it be desired to change the design of pick being used in the location illustrated in FIG. 4, the pick box may be withdrawn, and replaced by a different design of pick box, such as that illustrated in FIG. 5, which may be secured in the position illustrated in FIG. 4 by virtue of the commonality in the manner in which the pick box is secured to the shearer drum vane.

In FIGS. 4 and 5, the side plates 26 are shown engaging an end plate 13 of the mounting device, as distinct from a surface of the vane 3 bounding the slot 6.

Figure 6:
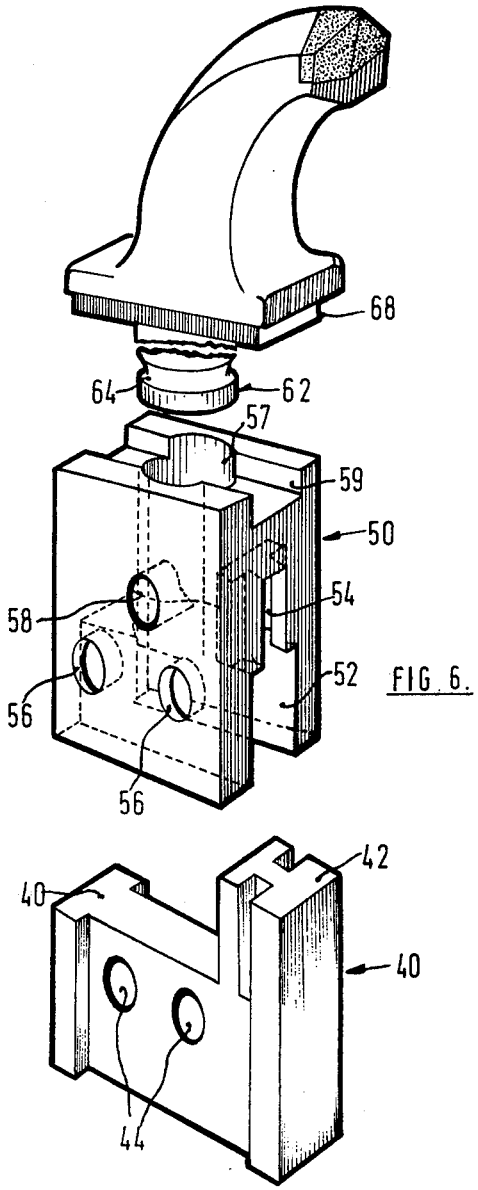
FIG. 6 is an exploded perspective view showing a modified form of mounting device.

In FIG. 6 a mounting device 40 is shown which is provided with an upwardly-extending dove-tail formation 42, and with two bores 44. The pick box 50 is provided with an interior recess 52, and a slot 54 is complimentary to the dove tail formation 42 enabling the box 50 to be vertically interfitted with the mounting device 40. When the pick box 50 is so interfitted with the device 40, axial load is taken between a flat abutment surface 46 of the device 40 and a complimentary interior surface of the pick box, whilst load in other directions is taken between the dove-tail formation 42 and the complimentary slot 54.

Thus, the mounting device may be welded in position, for example within a slot of the cutting head drum vane of a mining machine, and the pick box 50 may readily be secured thereto, by the use of bolts passed through the bores 44 of the member 40, and complimentary bores 56 of the pick box itself.

The pick box 50 is also provided with an axial bore 57, within which the stem 62 of a pick 60 may be located, said stem 62 being retained in position by a locking screw (not shown) inserted through a bore 58 of the pick box and inter-engagement with a circumferential groove 64 of the stem.

Whilst the locking screw prevents axial outward movement of the pick 60, turning movement thereof is prevented by the engagement of a rectangular shoulder 68 of the pick within a channel 59, provided at the upper end of the pick box 50.

We claim:

1. In a cutting drum for a mining machine, said cutting drum having at least one helically-extending vane from which mining picks extend, the improvement wherein the vane is provided at spaced intervals around its periphery with recesses within each of which recess there is secured a mounting device, the mounting device comprising a central mounting plate which extends in the circumferential direction of the vane, and front and rear end plates at opposite ends of the mounting plate which extend across the mounting plate, said front and rear end plates being secured to opposed faces of the vane bounding the recess, the end plates providing respectively rearwardly and forwardly facing abutment surfaces on both sides of the mounting plate, a pick box being releasably mounted on each mounting device, each pick box comprising opposed side walls which straddle the central mounting plate and which each have end faces which extend in closely abutting relationship with the abutment surfaces provided by the end plates, and each pick box carrying, releasably secured between said opposed side walls, a cutting pick.

2. The invention according to claim 1 wherein each mounting device is located within its associated recess wholly between the parallel planes of the side faces of the vane.

3. The invention according to claim 1 wherein the front end plate of the mounting device comprises an upwardly extending formation which engages within a complementary slot of the pick box.

* * * * *